US006183323B1

(12) United States Patent
Tanaka et al.

(10) Patent No.: US 6,183,323 B1
(45) Date of Patent: Feb. 6, 2001

(54) OUTBOARD MARINE DRIVE POWERED BY AN AIR-COOLED INTERNAL COMBUSTION ENGINE

(75) Inventors: Mitsuharu Tanaka; Tomonori Ikuma; Hiroshi Mizuguchi, all of Wako (JP)

(73) Assignee: Honda Giken Kogyo Kabushiki Kaisha, Tokyo (JP)

( * ) Notice: Under 35 U.S.C. 154(b), the term of this patent shall be extended for 0 days.

(21) Appl. No.: 09/151,741

(22) Filed: Sep. 11, 1998

(30) Foreign Application Priority Data

Sep. 12, 1997 (JP) ..... 9-249156

(51) Int. Cl.[7] ..... B63H 20/32
(52) U.S. Cl. ..... 440/77; 440/88
(58) Field of Search ..... 440/88, 77; 123/195 P, 123/41.65, 41.66, 41.7, 41.69, 198 E, 195 C

(56) References Cited

U.S. PATENT DOCUMENTS 4,692,123 * 9/1987 Tada et al. ..... 440/77
5,884,594 * 3/1999 Wiehle ..... 123/195 C

* cited by examiner

*Primary Examiner*—Sherman Basinger
(74) *Attorney, Agent, or Firm*—Skjerven Morrill MacPherson LLP; Alan H. MacPherson; Greg J. Michelson

(57) ABSTRACT

In an outboard marine drive, the engine is received in an under case, and is closed by both a fan cover and an engine cover so that the engine may be entirely covered by the engine cover jointly with the under case for a favorable aesthetic effect. However, the fan cover covers the engine closely in cooperation with the under case so that a narrow air passage is defined around the engine, and cooling air of high velocity can be continuously passed around the engine. Thus, according to the present invention, no part of the engine is exposed, but the fan cover surrounding the engine defines an appropriate gap around the engine for effectively guiding cooling air around the engine.

7 Claims, 4 Drawing Sheets

OUTBOARD MARINE DRIVE POWERED BY AN AIR-COOLED INTERNAL COMBUSTION ENGINE

TECHNICAL FIELD

The present invention relates to an outboard marine drive including an air cooled internal combustion engine which has a vertical crankshaft carrying a cooling air fan.

BACKGROUND OF THE INVENTION

It is advantageous to use an air-cooled internal combustion engine for a small outboard marine drive in view of reducing weight. Such an engine requires fresh cooling air to be continuously supplied for preventing the overheating of the engine. For aesthetic considerations and convenience of handling, it is desirable to cover the engine. Thus, conflicting requirements are imposed on small outboard marine engines. According to the invention disclosed in Japanese UM publication (kokoku) No. 2-23782, a cover is placed over the cylinder head of an outboard marine engine while the crankcase thereof is exposed. However, the aesthetic considerations are extremely important, and it is desired to minimize the exposure of the internal combustion engine.

BRIEF SUMMARY OF THE INVENTION

In view of such problems of the prior art, a primary object of the present invention is to provide an outboard marine drive using an air-cooled internal combustion engine which is relatively filly covered, but can be favorably air-cooled.

A second object of the present invention is to provide an outboard marine drive using an air-cooled internal combustion engine which is relatively fully covered, and light in weight.

A third object of the present invention is to provide an outboard marine drive using an air-cooled internal combustion engine which is relatively fully covered, and easy to service.

According to the present invention, these and other objects can be accomplished by providing an outboard marine drive having an internal combustion engine incorporated with a vertically oriented crankshaft and a cooling fan attached to an upper end of the crankshaft, comprising: an under case attached to a lower end of the engine, the under case being provided with a substantially cylindrical upright wall located inside an outer periphery of the under case so as to surround a lower part of the engine; an engine cover which is detachably attached to the under cover so as to jointly cover the engine and define a first chamber, the engine cover being provided with an air inlet to introduce cooling air into the first chamber; and a fan cover which jointly covers the engine and defines a second chamber inside the first chamber, the fan cover being provided with an air inlet opposite to the cooling fan, while the under case is provided with an air outlet for expelling cooling air out of the second chamber; wherein a lower peripheral edge of the fan cover abuts an opposing upper peripheral edge of the cylindrical upright wall of the under case.

Thus, the fan cover can cover the engine closely in cooperation with the under case so that a narrow air passage is defined around the engine, and cooling air of high velocity can be continuously passed around the engine. This enhances the cooling effect such that the engine can be substantially entirely covered without risking the possibility of overheating the engine. In particular, by providing the lower peripheral edge of the fan cover with a peripheral groove which receives the opposing upper peripheral edge of the cylindrical upright wall of the under case, it is possible to firmly secure the fan cover relative to the under case which can be firmly attached to a lower part of the engine. Additionally, the opposing edges of the fan cover and the under case may be provided with a plurality of pin and hole engagement arrangements for positioning the fan cover relative to the under case against any lateral movement.

Preferably, the air inlet of the engine cover is provided at an upper rear part of the engine cover, and the inlet of the fan cover is provided in an upper part of the fan cover. Also, the provision of the first chamber defined between the engine cover and the fan cover prevents water which may get into the first chamber from reaching the second chamber. Therefore, the engine can be properly protected from ill effects resulting from the intrusion of water into the first chamber.

Typically, a recoil starter is attached to an upper part of the engine, and may be placed in an upper part of the fan cover in such a manner that the inlet of the fan cover is provided in a cover of the recoil starter. To even further enhance the cooling effect, an air guide plate may be provided inside the second chamber for directing cooling air toward a crankcase of the engine. To minimize the number of component parts and simplify the assembly work, the air guide plate consists of an extension of a gasket interposed between a base end of an exhaust pipe and a corresponding exhaust port of the engine.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
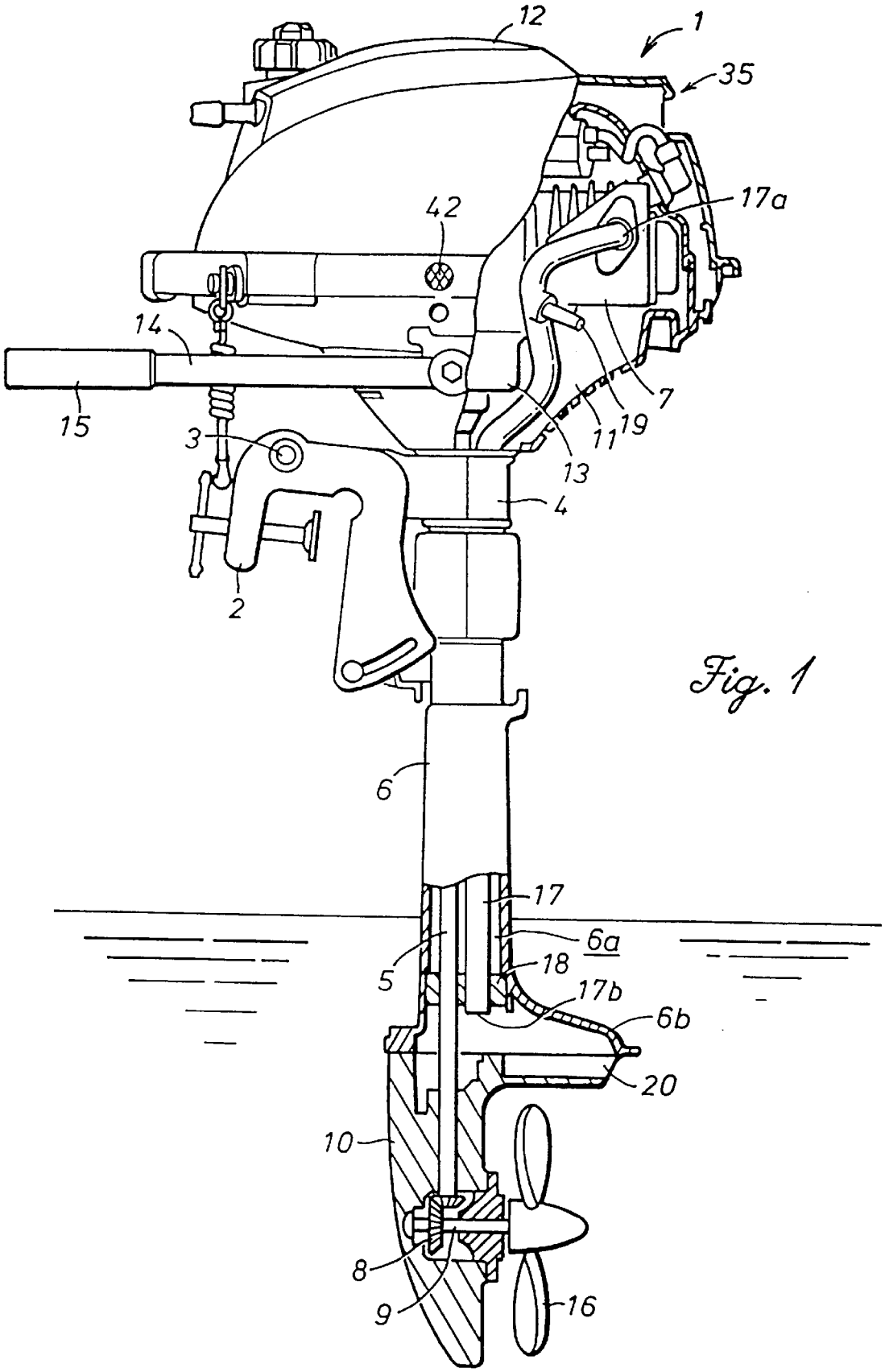
FIG. 1 is a partly broken-away side view of an outboard marine drive embodying the present invention.

FIG. 1 generally illustrates a side view of an outboard marine drive embodying the present invention. This outboard marine drive 1 is adapted to be attached to a transom of a boat (not shown in the drawing) with a stem bracket 2 having a clamping capability. Stem bracket 2 is attached to a swivel case 4 via a tilt shaft 3 extending horizontally across the width of the boat. Swivel case 4 in turn supports a tubular extension case 6 accommodating therein a vertically extending drive shaft 5. Swivel case 4 permits the main part of the outboard marine drive to rotate 360 degrees around a vertical steering axis relative to stem bracket 2 of the boat.

The upper end of extension case 6 is attached to an internal combustion engine 7, and lower end 6*b* of extension case 6 is attached to a gear case 10 accommodating, in interior 6*a* of extension case 6, a propeller shaft 9 and a bevel gear mechanism 8 for transmitting the rotative power from the lower end of drive shaft 5 to propeller shaft 9.

Figure 2:
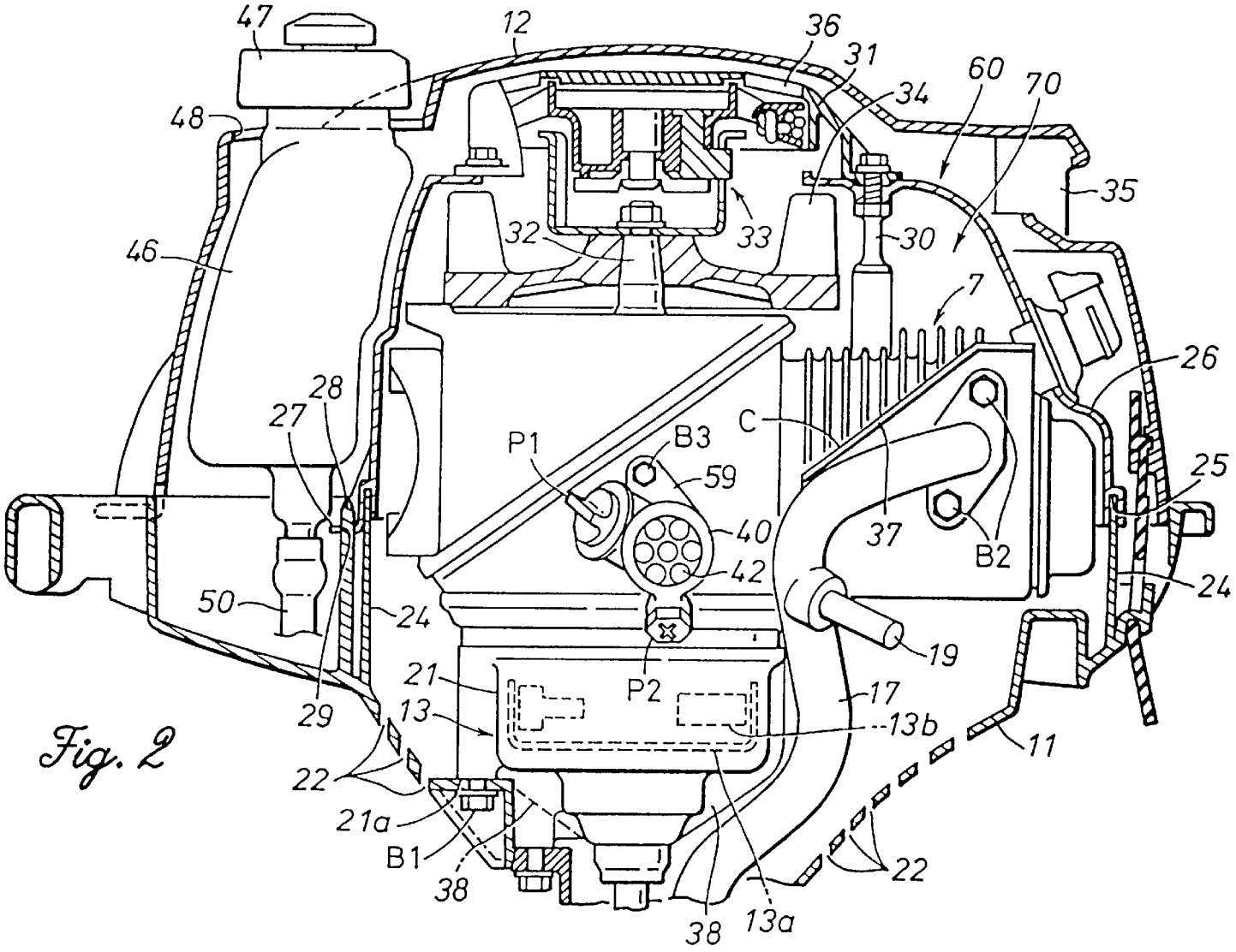
FIG. 2 is a partly broken-away side view of the engine and the surrounding arrangement.

Engine 7 consists of a vertical-crankshaft, air-cooled, single-cylinder, four-stroke internal combustion engine, and is generally covered by an under case 11 and an engine cover 12 which are detachably joined with each other. The cylinder head of engine 7 is directed rearward with a slight angular offset to one side. The lower end of a crankshaft 32 (FIG. 2) of engine 7 is connected to the upper end of drive shaft 5 via a known centrifugal clutch device 13. Under case 11 is attached to the bottom surface of a housing of centrifugal clutch device 13 so that engine cover 12 may be removed while under case 11 is kept attached to engine 7.

Figure 3:
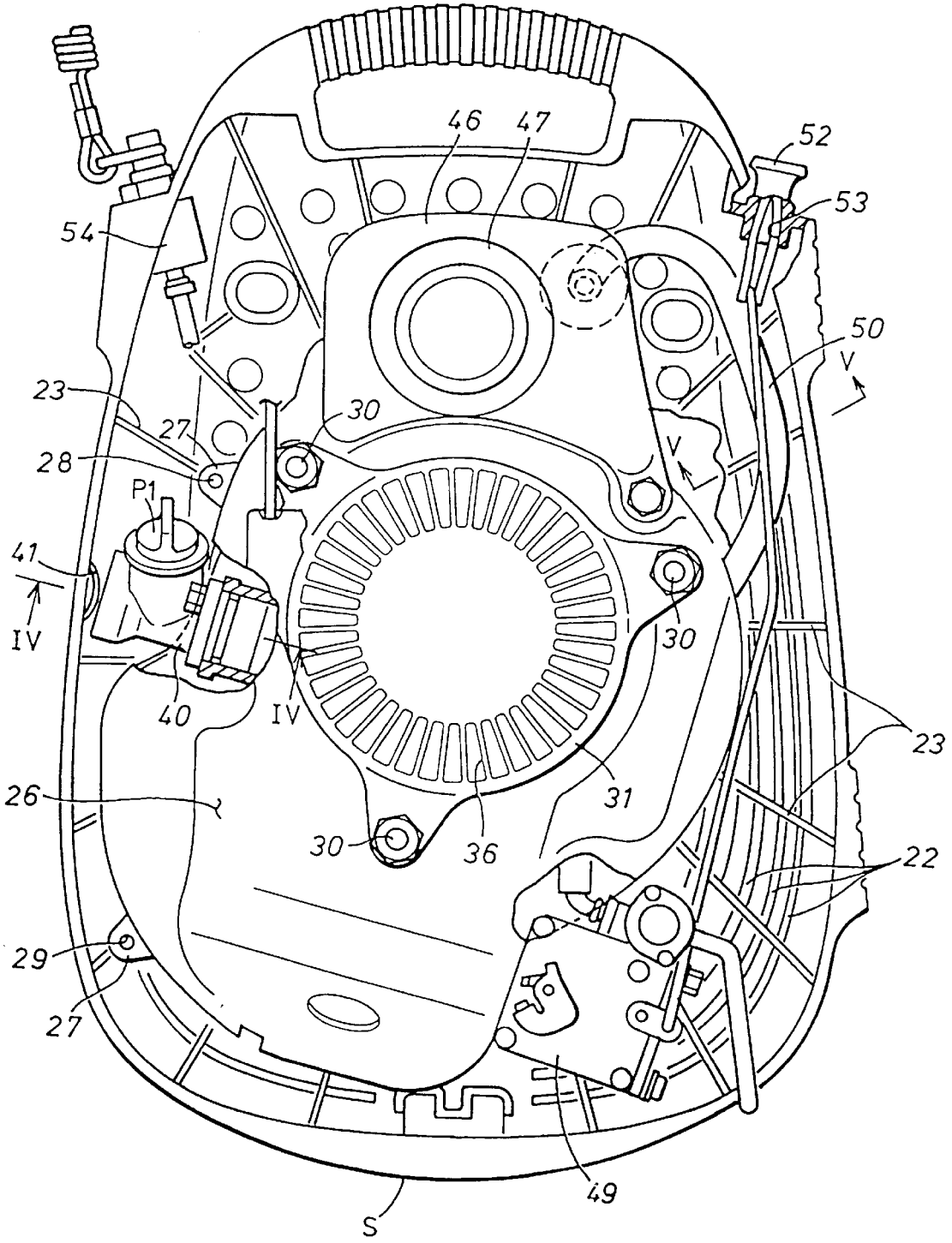
FIG. 3 is a partly broken-away plan view of the outboard marine drive with its engine cover removed for showing the parts surrounding the engine.
Figure 4:
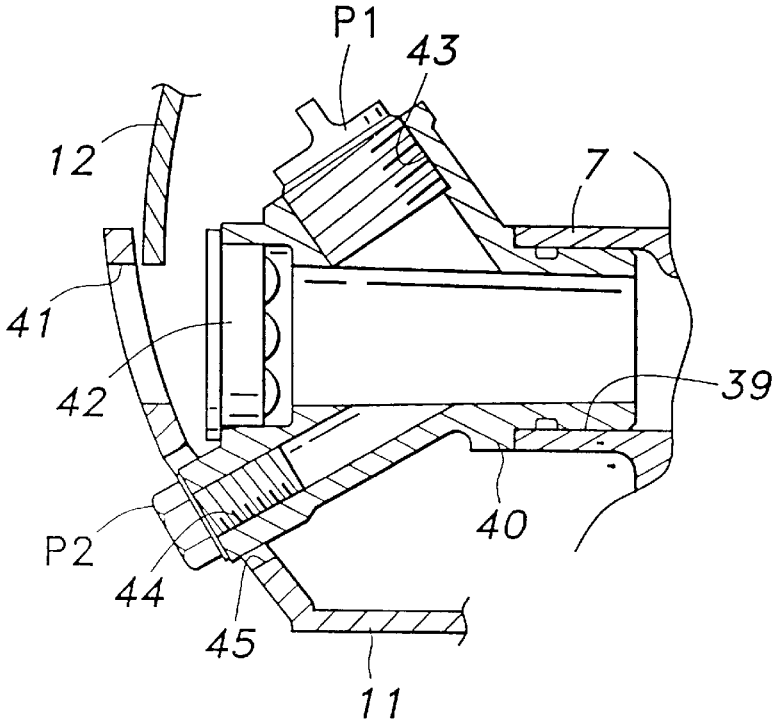
FIG. 4 is a fragmentary sectional view taken along line IV—IV of FIG. 3.

The housing of centrifugal clutch device 13 is provided with an arm (not shown in the drawings) which extends out of under case 11, and a free end of this arm is attached to a steering arm 14 which can turn in a horizontal plane. Thus, by angularly moving steering arm 14, the outboard marine drive main body can be turned around a vertical axis for steering the boat. A free end of steering arm 14 is provided with a throttle grip 15 for operating a throttle valve of a carburetor 49 (FIG. 3). When the rotational speed of engine 7 is increased beyond a certain level by suitably twisting throttle grip 15, centrifugal clutch device 13 is engaged, and the rotational power of the crankshaft is transmitted to propeller 16 via drive shaft 5 and propeller shaft 9.

An exhaust pipe 17 has an upper end 17*a* which is connected to an exhaust port of the cylinder block, and extends from the engine room into extension case 6 along a curved path. Lower end 17*b* of exhaust pipe 17 terminates at a point adjacent to lower end 6*b* of extension case 6. Exhaust pipe 17 extends substantially in parallel with drive shaft 5 inside extension case 6, and its lower end 17*b* is supported by a circular partition member 18 which is made of resilient elastomeric material and fitted into a bore defined at lower end 6*b* of extension case 6. An inlet opening 19 is provided in a curved part of exhaust pipe 17 adjacent to the cylinder block for receiving a probe for analyzing the contents of the exhaust gas.

The exhaust gas from engine 7 is released from lower end 17*b* of exhaust pipe 17, and is normally released into the water from an opening 20 defined in the interface between extension case 6 and gear case 10. The exhaust gas is then pushed rearward in the water by the water flow produced by propeller 16. Because interior 6*a* of extension case 6 is separated from the lower part thereof by partition member 18, the exhaust gas is prevented from flowing upward inside extension case 6.

Now is described the part of this outboard marine drive associated with engine 7 referring to FIGS. 2–5. Engine 7 is covered jointly by under case 11 and engine cover 12 as mentioned earlier, and under case 11 is secured to a lower surface 21*a* of a clutch housing 21 by bolts B1 while engine cover 12 is detachably attached to the open end of under case 11. The inner bottom surface of under case 11 is provided with a number of slots 22 for ventilation, and a number of reinforcement ribs 23 extending radially from the axial center of the crankshaft. Under case 11 is further provided with a substantially cylindrical upright wall 24 surrounding a lower part of engine 7. In fact, upright wall 24 has a profile which closely surrounds the lower part of engine 7.

A fan cover 26 is placed over an upper part of engine 7, and is held in place by virtue of a U-shaped groove 25 formed in the lower edge thereof receiving an upper edge of upright wall 24. The mutually abutting edges of fan cover 26 and under case 11 are conformally profiled as can be readily appreciated. The lower edge of fan cover 26 is provided with a plurality of tabs 27. Locator pins 28 standing upright from the bottom surface of under case 11 fit into holes 29 provided in tabs 27 for properly positioning fan cover 26 relative to under case 11 against any lateral movement.

Fan cover 26 is firmly secured to engine 7, along with a recoil starter 31 placed over engine 7, by stud bolts 30 extending from engine 7. Thus, engine cover 12 and under case 11 jointly define a first chamber 60, and fan cover 26 and lower case 11 jointly define a second chamber 70 inside first chamber 60. Recoil starter 31 is connected to the upper end of crankshaft 32 of engine 7 via a coupling 33 which engages and disengages through an axial movement of an engagement member. The upper end of crankshaft 32 is also provided with a centrifugal cooling air fan 34 serving also as a flywheel so that when crankshaft 32 is turning, air introduced from air inlets 35 formed along an outer periphery of an upper rear part of engine cover 12 is drawn into fan cover 26 via openings 36 formed in the upper wall of the cover of recoil starter 31, and after cooling engine 7, is expelled from the housing assembly through ventilating slots 22 formed in the bottom wall of under case 11.

An air guide plate 37 having an inclined surface C inclining downward toward the crankcase is attached to a side of the cylinder block of engine 7. This air guide plate 37 is formed by an extension of a metal gasket interposed between the cylinder block and the flanged end of exhaust pipe 17, and is secured by bolts B2 which secure exhaust pipe 17 to the cylinder block. Thus, the flow rate of the cooling air around the crankcase can be maximized without increasing the number of component parts or the amount of work required for the assembly work. Alternatively, the air guide plate may be integrally formed with the cylinder block or fan cover 26. The size of the gap between the inner surface of fan cover 26 and the outer surface of engine 7 can be appropriately selected so as to achieve a desired amount or speed of air flow at each selected location of engine 7. Also, by providing cooling fins 38 on the outer circumferential surface of clutch housing 21, it is possible to enhance the cooling of a clutch drum 13*a* and a clutch shoe 13*b* incorporated in clutch housing 21.

A socket member 40 is fitted into an opening 39 defined in the crankcase of engine 7 with the center of this opening substantially coinciding with a normal oil level in the crankcase. Socket member 40 is provided with an inner end closely received in the opening 39 (FIG. 4) of the crankcase, and a tab 59 (FIG. 2) having an opening through which a threaded bolt B3 is passed and threaded into a threaded bore of the crankcase so as to fixedly secure socket member 40 relative to the crankcase. An outer end of socket member 40 terminates adjacent to an access hole 41 formed in a side wall of under case 11, and is fitted with a level gauge window 42 made of transparent plastic material.

Socket member 40 is additionally provided with a filler pipe 43 extending upwardly at an oblique angle and a drain pipe 44 extending downwardly at an oblique angle. Pipes 43 and 44 are normally closed liquid-tight by threaded plugs P1 and P2, respectively. The outer end of filler pipe 43 can be exposed simply by removing engine cover 12 as it is located above the open upper end of under case 11. The outer end of drain pipe 44 is passed through a circular opening 45 provided in under case 11 immediately below access opening 41 for level gauge window 42 so that plug P2 can be easily fitted and removed in and out of drain pipe 44 from outside under case 11.

Figure 5:
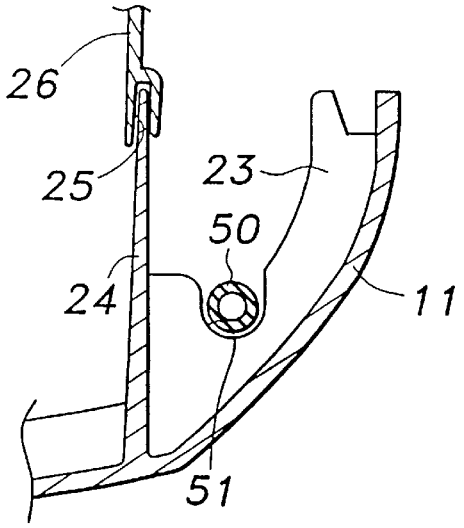
FIG. 5 is a fragmentary sectional view taken along line V—V of FIG. 3.

Between engine cover 12 on the side of the crankcase of engine 7 and fan cover 26 (or in the front end of engine cover 12) is disposed a fuel tank 46 which is fixedly secured to fan cover 26. Fuel tank 46 is provided with a filler cap 47 which projects from an opening 48 provided in an upper part of engine cover 12 so that fuel can be filled into fuel tank 46 without removing engine cover 12. A hose 50 for supplying fuel from fuel tank 46 to carburetor 49 (FIG. 3) which is attached to the cylinder head side (rear end) of engine 7 is passed inside under case 11. Hose 50 is positioned in under case 11 by being fitted into U-shaped notches 51 provided in radial ribs 23 at suitable locations as best illustrated in FIG. 5.

A choke knob 52 attached to a choke lever of carburetor 49 is directly engaged by an opening 53 provided in under case 11 so as to apply a suitable frictional retaining force thereto while minimizing the number of component parts and the amount of work required for assembly.

The outer profile S of under case 11 on the side of the cylinder head is generally circular with its center of curvature offset from the center of gravity of the engine toward the cylinder head. Therefore, even when the outboard marine drive is placed with its cylinder head down (typically in storage) on the floor, because the center of gravity of the engine is located above the center of curvature of the outer profile S, the engine rolls either way until either side thereof is always oriented horizontally, and the lubricating oil is prevented from remaining in the cylinder head. As well known in the art, filling the combustion chamber with lubricating oil over time is harmful for the durability of the engine. If the outer profile of the rear end or the cylinder head end of the engine assembly is not circular, the profile of the engine assembly and the positioning of the gravitational center should be so selected in such a manner that the orientation of the assembly with its cylinder head facing down is unstable when placed on a floor, and the engine assembly rolls over the floor until either side thereof faces down. Numeral 54 denotes a kill switch.

Thus, according to the present invention, an engine can be generally covered by a casing so that no part of the engine is exposed, and the fan cover surrounding the engine defines an appropriate gap around the engine for effectively guiding cooling air around the engine.

Although the present invention has been described in terms of a preferred embodiment thereof, it is obvious to a person skilled in the art that various alterations and modifications are possible without departing from the scope of the present invention which is set forth in the appended claims.

What is claimed is:

1. An outboard marine drive having an internal combustion engine incorporated with a vertically oriented crankshaft and a cooling fan attached to an upper end of said crankshaft, comprising:

an under case attached to a lower end of said engine, said under case being provided with a substantially cylindrical upright wall located inside an outer periphery of said under case so as to surround a lower part of said engine;

an engine cover which is detachably attached to said under case at an outer peripheral part of said engine cover and said under case so as to jointly cover said engine and define a first chamber, said engine cover being provided with an air inlet to introduce cooling air into said first chamber; and a fan cover which covers said engine jointly with said under case and defines a second chamber inside said first chamber, said fan cover being provided with an air inlet opposite to said cooling fan, said under case being provided with an air outlet for allowing cooling air to pass out of said second chamber;

wherein a lower peripheral edge of said fan cover abuts an opposing upper peripheral edge of said cylindrical upright wall of said under case.

2. An outboard marine drive according to claim 1, wherein said lower peripheral edge of said fan cover is provided with a peripheral groove which receives said opposing upper peripheral edge of said cylindrical upright wall of said under case.

3. An outboard marine drive according to claim 2, wherein said opposing edges of said fan cover and said under case are provided with a plurality of pin and hole engagement arrangements for positioning said fan cover relative to said under case and preventing any lateral movement.

4. An outboard marine drive according to claim 1, wherein said air inlet of said engine cover is provided at an upper rear part of said engine cover, and said inlet of said fan cover is provided in an upper part of said fan cover.

5. An outboard marine drive according to claim 4, wherein a recoil starter is attached to an upper end of said fan cover, and said air inlet of said fan cover is provided in a cover of said recoil starter.

6. An outboard marine drive according to claim 1, wherein an air guide plate is provided inside said second chamber for directing cooling air toward a crankcase of said engine.

7. An outboard marine drive according to claim 6, wherein said air guide plate consists of an extension of a gasket interposed between a base end of an exhaust pipe and a corresponding exhaust port of the engine.

* * * * *